US009421441B2

(12) United States Patent
Cross

(10) Patent No.: US 9,421,441 B2
(45) Date of Patent: Aug. 23, 2016

(54) HOCKEY STICK

(71) Applicant: Dave Cross, Parker, CO (US)

(72) Inventor: Dave Cross, Parker, CO (US)

( * ) Notice: Subject to any disclaimer, the term of this patent is extended or adjusted under 35 U.S.C. 154(b) by 0 days.

(21) Appl. No.: 14/051,200

(22) Filed: Oct. 10, 2013

(65) Prior Publication Data

US 2014/0100064 A1 Apr. 10, 2014

Related U.S. Application Data

(60) Provisional application No. 61/712,209, filed on Oct. 10, 2012.

(51) Int. Cl.
*A63B 59/14* (2006.01)
*A63B 59/00* (2015.01)

(52) U.S. Cl.
CPC ..... *A63B 59/14* (2013.01); *A63B 59/0014* (2013.01); *A63B 59/70* (2015.10); *A63B 60/34* (2015.10); *A63B 2102/24* (2015.10)

(58) Field of Classification Search
CPC ..... A63B 59/14; A63B 59/0014; A63B 2102/24; A63B 59/70
USPC ..... 473/560–563
See application file for complete search history.

(56) References Cited

U.S. PATENT DOCUMENTS

| | | | | | |
|---|---|---|---|---|---|
| 1,183,473 | A * | 5/1916 | McNiece | 473/560 |
| D263,329 | S * | 3/1982 | Clayton | D21/727 |
| 4,544,157 | A * | 10/1985 | Curtis | 473/560 |
| D344,115 | S * | 2/1994 | Goyette | D21/727 |
| 5,456,463 | A * | 10/1995 | Dolan et al. | 473/563 |
| D406,625 | S * | 3/1999 | Hutzenlaub | D21/727 |
| 6,099,421 | A * | 8/2000 | Mayhew | 473/560 |
| D431,621 | S * | 10/2000 | Pagotto et al. | D21/727 |
| D496,703 | S * | 9/2004 | Gans | D21/727 |
| 7,282,001 | B2 * | 10/2007 | Ponzini | 473/560 |
| 8,251,844 | B2 | 8/2012 | Cross et al. | |
| D684,225 | S * | 6/2013 | LaCroix | D21/727 |
| 2006/0281591 | A1 * | 12/2006 | Wikstrom et al. | 473/560 |
| 2012/0202625 | A1 * | 8/2012 | McGibbon | 473/561 |

* cited by examiner

*Primary Examiner* — Mark Graham
(74) *Attorney, Agent, or Firm* — Sheridan Ross P.C.

(57) ABSTRACT

A goalkeeper's hockey stick with an angled shaft is disclosed. The goalkeeper stick is comprised of a shaft, paddle and blade. The shaft connects to the paddle which connects to the blade. The portion of the shaft where it connects to the paddle is beveled to provide a grip portion of the shaft where the goalkeeper's gloved hand can grip the stick in a way that provides a more ergonomic position for the goalkeeper's hand.

10 Claims, 12 Drawing Sheets

HOCKEY STICK

CROSS-REFERENCE TO RELATED APPLICATIONS

This application is a claims priority to, under 35 USC §119, to Provisional Patent Application Ser. No. 61/712,209, filed on Oct. 10, 2012, entitled "IMPROVED HOCKEY STICK," which contents are hereby incorporated by reference for all that they teach and for all purposes. This application is also related to U.S. Pat. No. 8,251,844, filed Dec. 23, 2010, entitled "GOALKEEPER STICK WITH ANGLED SHAFT," which contents are hereby incorporated by reference for all that they teach and for all purposes.

BACKGROUND OF THE INVENTION

This invention relates to a hockey stick and more particularly to a hockey stick used by a goaltender or goalkeeper in the sport of ice hockey.

Sticks used by hockey players other than the goalkeeper are very similar, and their construction and design have not changed much over the years, being regulation by governing bodies such as the National Hockey League. The standard ice hockey stick is a piece of equipment used in ice hockey to shoot, pass, and carry the puck. Ice hockey sticks are approximately 65 inches long, composed of a long, slender shaft with a flat extension at one end called the blade. The blade is the part of the stick used to contact the puck, and is typically 15.5 inches long. Stick dimensions can vary widely, as they are usually built to suit a particular player's size and preference. The blade is positioned at roughly a 135° angle from the axis of the shaft, giving the stick a partly 'L-shaped' appearance. The shaft of the stick is fairly rigid, but it has some flexibility to benefit some shots. Also, the blade may be slightly curved in one direction, to aid in retaining or lifting the puck off the playing surface. This can be to the left or right, depending on the player's preference.

Most currently know sticks used by a goalkeeper are formed with a straight shaft attached to the center of a widened portion of the stick called a paddle. The paddle has a heel portion where it is joined to the blade, giving the hockey stick its somewhat L-shape. The goalkeeper has a slightly modified stick from the standard stick used by the other players. The lower part of the stick is wider, the angle is smaller, and the blade is slightly curved towards the direction of the play. According to NHL rules, the blade of the goalkeeper's stick cannot exceed three and one-half inches (3½") in width at any point except at the heel, where it must not exceed four and one-half inches (4½") in width; nor can the goalkeeper's stick exceed fifteen and one-half inches (15½") in length from the heel to the end of the blade. The widened portion of the goalkeeper's stick extending up the shaft from the blade ranges from 22 inches to 32 inches and can be not more that 3.5 inches in width.

The prior art discloses other inventions that have modified hockey goalkeeper sticks. For example, U.S. Pat. No. 5,456,463, (Dolan), describes a notched handgrip formed along a length of the shaft at a position between the widened shaft portion and the handle portion. However, this design constricts movement of the goalkeeper's hand along the shaft due to the ribbed handgrips on the shaft handle. In Dolan, the fingered handgrip prevents the hand from flowing smoothly along the shaft and does not allow sufficient space for clearance of the goalkeeper's gloved hand, which, together with the knob on the end of the shaft, prevents the shaft and paddle from laying horizontally on the playing surface.

U.S. Pat. No. 4,544,157 (Curtis) describes a goalkeeper's hockey stick having a bent shaft that can rest flush against the surface of the playing surface. Such a design, however, is impractical because the goalkeeper is unable to grip his or her fingers around the upper portion of the shaft while the stick is resting flush against the playing surface.

SUMMARY OF THE INVENTION

According to the invention, a goalkeeper's stick is comprised of a shaft, a paddle and a blade. The portion of the shaft where it connects to the paddle is angled to the top portion of the paddle to allow the shaft and paddle to lay horizontally on the playing surface. The angled shaft provides clearance for the goalkeeper to grip that portion of the shaft with the goalkeeper's gloved hand while allowing both the paddle and the shaft to lay flat on the playing surface so as to block the puck.

An aspect of the invention includes A hockey stick for use by the goalkeeper in playing hockey on a playing surface, the stick being comprised of: a shaft having a lower edge and a top edge; a paddle having a first end and a second end, a front face and a back face, a top edge and a bottom edge, and a center portion between the top and bottom edges, the first end being combined with the shaft substantially at the center portion of the paddle; a blade combined with the paddle at the second end and angled from the paddle; a grip portion formed at the first end of the paddle, wherein the grip portion includes a first and second portion of the first end formed on either side of the shaft, wherein a concave is formed in the first portion, wherein a slope is formed with the second portion, wherein a bevel is formed in the front face of the second portion, and wherein the grip portion of the shaft provides a space for the goalkeeper's hand to grip the shaft at the correct angle of the goalkeeper's arm while allowing the goalkeeper to extend one or more fingers along a face of the paddle to control the angled hockey stick.

DETAILED DESCRIPTION OF THE PREFERRED EMBODIMENTS

The goalkeeper stick show in drawings is a hockey stick for use by a goaltender or goalkeeper in the game of ice hockey.

Figure 2:
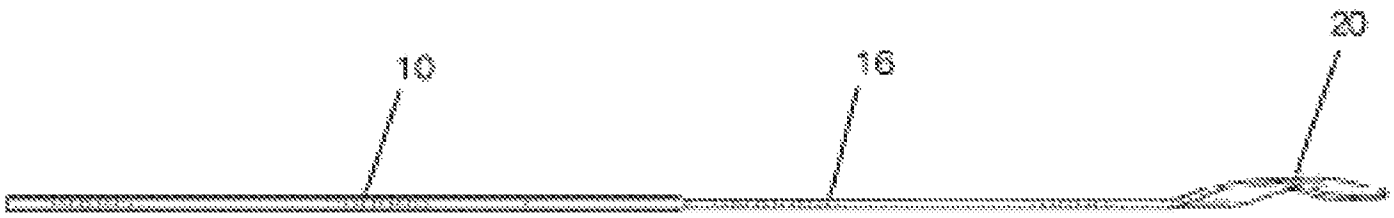
FIG. 2 is a front edge view of the stick of FIG. 1.

The stick of the invention is comprised of a long, straight shaft 10 having a relatively narrow cross sectional shape with a bottom edge and a top edge. The shaft angles upwardly to form a grip portion 12 that is joined to the top 14 of the rear edge 15 of a wider portion of the stick called the paddle 16. The paddle 16 has a straight portion 17 and a heel 18 where the curved portion of the paddle 16 joins the blade 20. The straight portion 17 is in the same plane as the bottom edge of the shaft 10. The blade 20 has a height and thickness substantially the same as the paddle 16 and may be slightly curved as best seen in FIG. 2. From the straight portion 17 of the paddle 16 upwardly to where the grip portion 12 of the shaft 10 joins the paddle 16 the rear edge 15 is angled inwardly toward the paddle 16. The grip portion 12 thus forms an angled hand grip where the goalkeeper wearing a glove can grip the stick.

The shaft 10 can vary in length, but the following are the preferred dimensions of the stick. The stick usually is not more than 63 inches from the heel 18 to the end of the shaft 10. The grip portion 12 of the shaft 10 is about 8 inches in length so as to accommodate the gloved hand of the goalkeeper. The cross sectional dimensions of both the shaft 10 and the grip portion 12 are about 1.5 inches wide and 0.5 inches thick. The angled rear edge 15 of the paddle 16 is about 2 inches in length, while the length of the paddle 16 from the rear edge 15 to the heel 18 is about 26 inches. The height of the paddle 16 is about 3.5 inches, and the height of the blade 20 is about 3.5 inches except at the heel 18 where it is about 4.5 inches. The length of the blade 20 from the heel 18 to the end of the blade 20 is about 15.5 inches.

Figure 3:
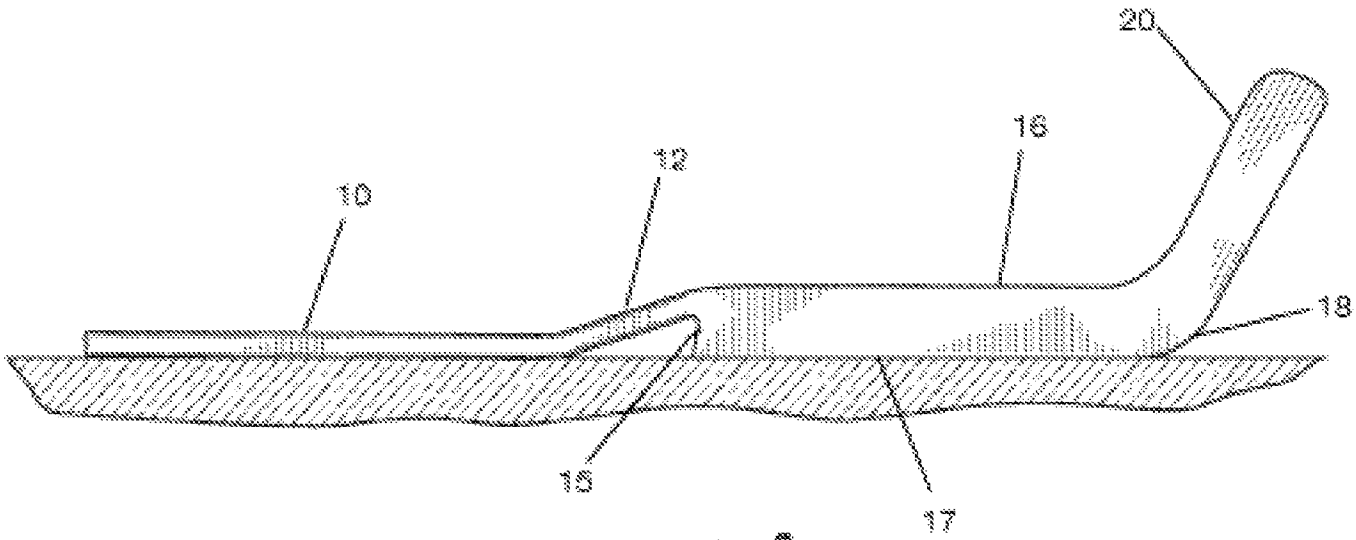
FIG. 3 is a view of the stick of FIG. 1 as it lays on the playing surface to illustrate how it is used to block a puck.

As illustrated in FIG. 3, when the stick is used by a goalkeeper to block a shot, the bottom edge of the shaft 10 and straight portion 17 of the paddle 16 are in the same plane and thus can lay horizontally on the playing surface with no gap between the stick anywhere and the playing surface. When a player, the goalkeeper, holds the shaft 10 at the grip portion 12, there is sufficient space beneath the grip portion 12 and the playing surface that the glove of the goalkeeper does not interfere with the shaft 10 and paddle 16 from being held flush with the playing surface. The cross sectional shape of the grip portion 12 is the same size as that of the shaft 10, which allows the player's hand to move smoothly along the entire shaft. Thus, the goalkeeper can quickly slide the gloved hand down the shaft 10 to the grip portion 12 and into the space created beneath the grip portion 12 against the angled second portion 22.

Figure 1:
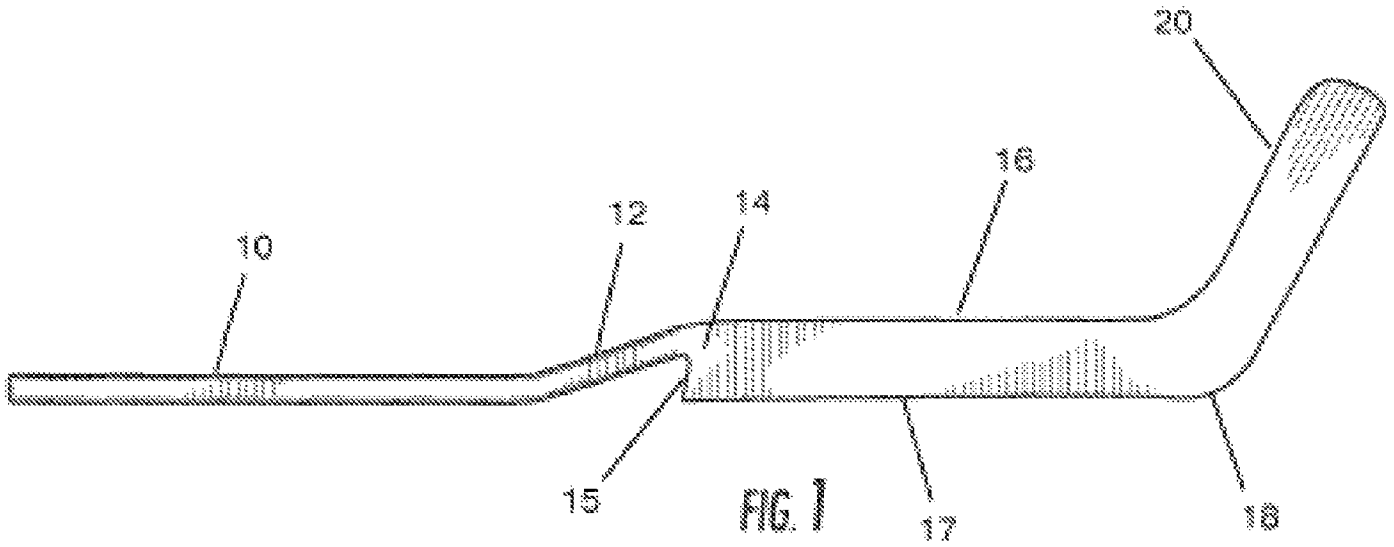
FIG. 1 is a side view of the goalkeeper stick of the invention.
Figure 4:
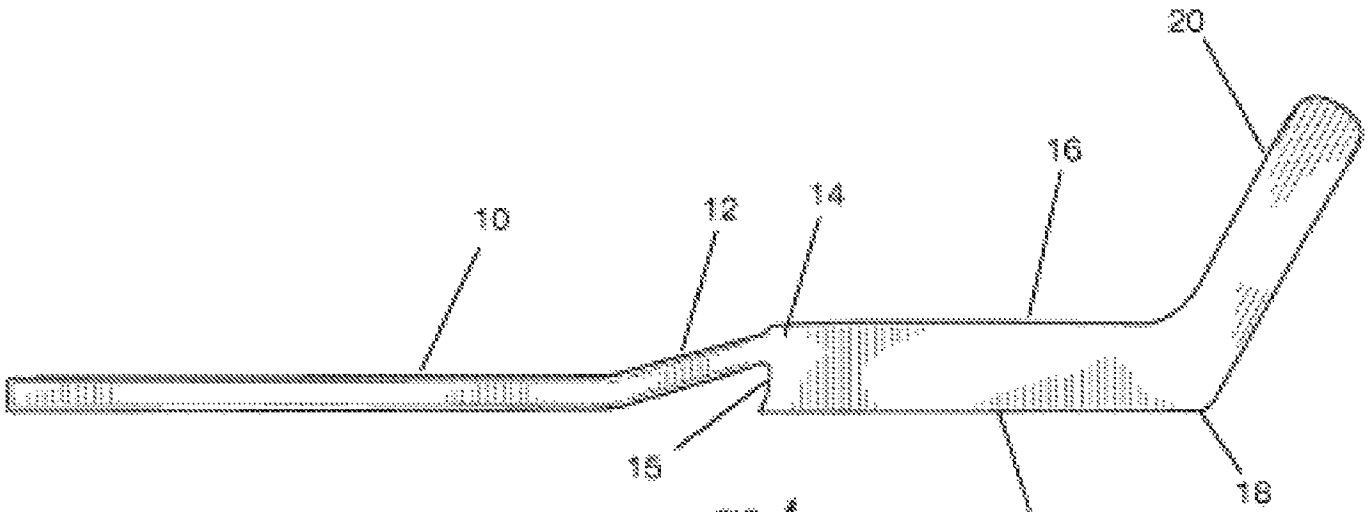
FIG. 4 is a side view of a stick similar to FIG. 1 but showing another embodiment of the goalkeeper's stick.

Referring now to FIG. 4, there is shown another embodiment of the invention. In this embodiment, the structure and dimensions of the hockey stick are substantially the same as the hockey stick of the first embodiment of FIGS. 1-3 with the following exceptions. Where the grip portion 12 is joined to the rear edge 15 of the paddle 16 has been lowered slightly from the top of the rear edge 15 and the rear edge is slightly concave to assist in maintaining the gloved hand of the goal keeper in place. This may also give a slightly different 'feel' of the stick by the player, but these modifications do not in any way alter the way in which the hockey stick is used by the player as described above with reference to the first embodiment.

Figure 5:
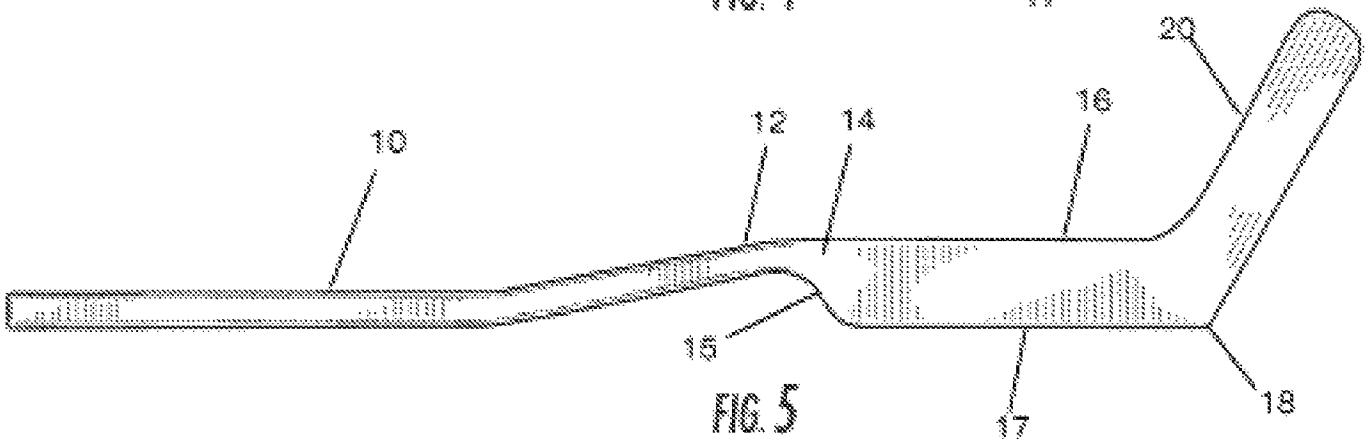
FIG. 5 is a side view of a stick similar to FIG. 1 but showing yet another embodiment of the goalkeeper's stick.

FIG. 5 shows yet another embodiment of the invention. In this embodiment, the structure and dimensions of the hockey stick are substantially the same as the hockey stick of the first embodiment of FIGS. 1-3 with the following exceptions. Similar to the hockey stick of FIGS. 1-3, the grip portion 12 is joined to the rear edge 15 of the paddle 16 at the top of the rear edge 15, but the rear edge 15 of the paddle 16 slopes inwardly toward the heel 18 of the paddle 16. This provides a slightly larger area for the gloved hand of the goal keeper and may provide a slightly different feel that some players prefer. However, these modifications do not in any way alter the way in which the hockey stick is used by the player as described above with reference to the first embodiment.

Having thus described the invention in connection with the preferred embodiments thereof, it will be evident to those skilled in the art that various revisions can be made to the preferred embodiments described herein without departing from the spirit and scope of the invention. It is our intention, however, that all such revisions and modifications that are evident to those skilled in the art will be included within the scope of the following claims.

Figure 6A:
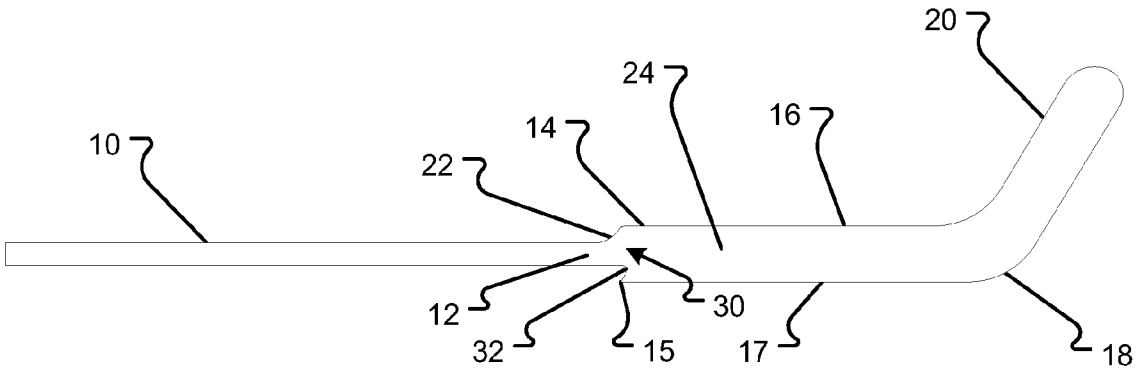
FIG. 6A is a side view of another embodiment of the goalkeeper's stick.

FIG. 6A through FIG. 13 show yet another embodiment of the hockey stick. According to the rules of the International Ice Hockey Federation (IIHF), the shaft 10 of the goalie hockey stick must attach to a center portion 30 of the paddle 16. Thus, another design for the goalie hockey stick is shown in FIGS. 6A and 6B, which complies with the rules of the IIHF.

The structure and dimensions of the hockey stick may be substantially the same as the hockey stick of the other embodiments of FIGS. 1-5 with the following exceptions. The shaft 10 can be connected to a center portion 30 of the paddle 16. The grip portion 12 can be joined to and bisect the rear edge 15 of the paddle 16 at a middle or center portion 30 of the rear edge 15. A first portion 32 of the rear edge 15 of the paddle 16 can be curved toward the heel 18 of the paddle 16. The configuration of the first portion 32 creates a concave which may assist in maintaining a proper or better position for the gloved hand of the goaltender. This configuration of the first portion 32 of the rear edge 15 may also provide a slightly larger area for the gloved hand of the goal keeper and may provide a slightly different feel that some players prefer. A second portion 22 of the rear edge 15 may slope towards the end of the shaft and/or away from the blade 20. One or more of the faces of the second portion 22 may be beveled to allow for a more comfortable position and grip for the player.

Figure 6B:
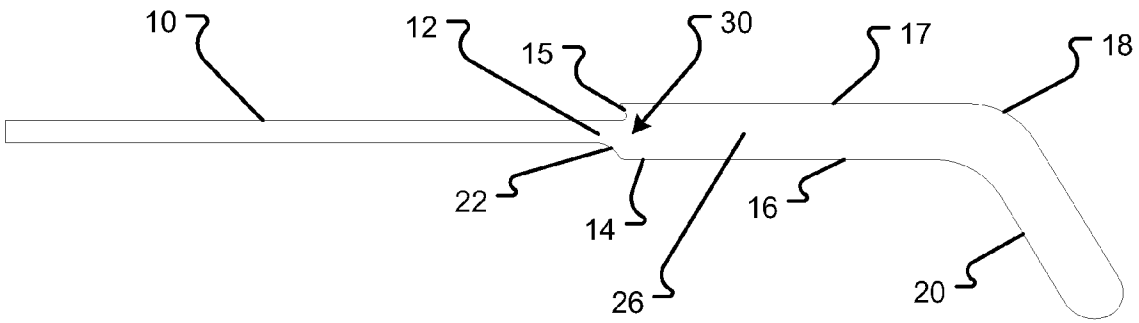
FIG. 6B is another side view of the goalkeeper's stick shown in FIG. 6A.
Figure 7:
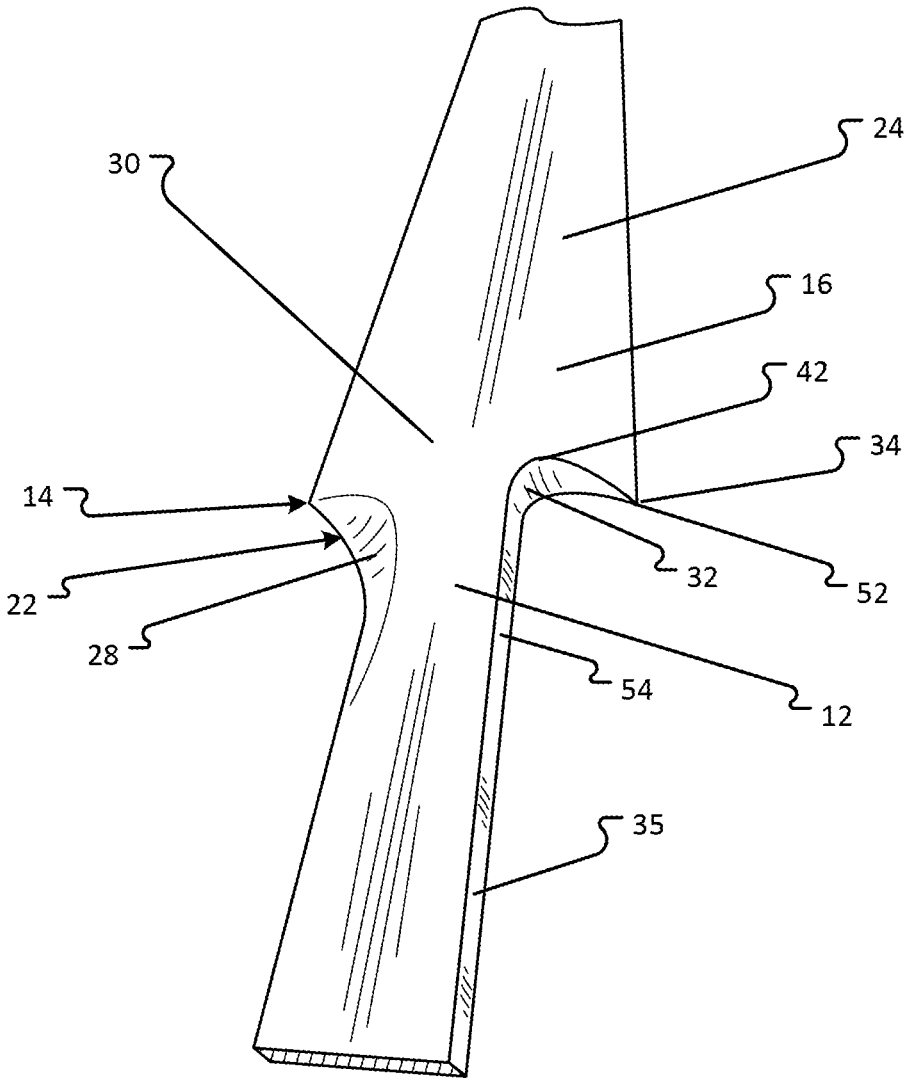
FIG. 7 is three-dimensional view of the goalkeeper's stick shown in FIGS. 6A and 6B.
Figure 8:
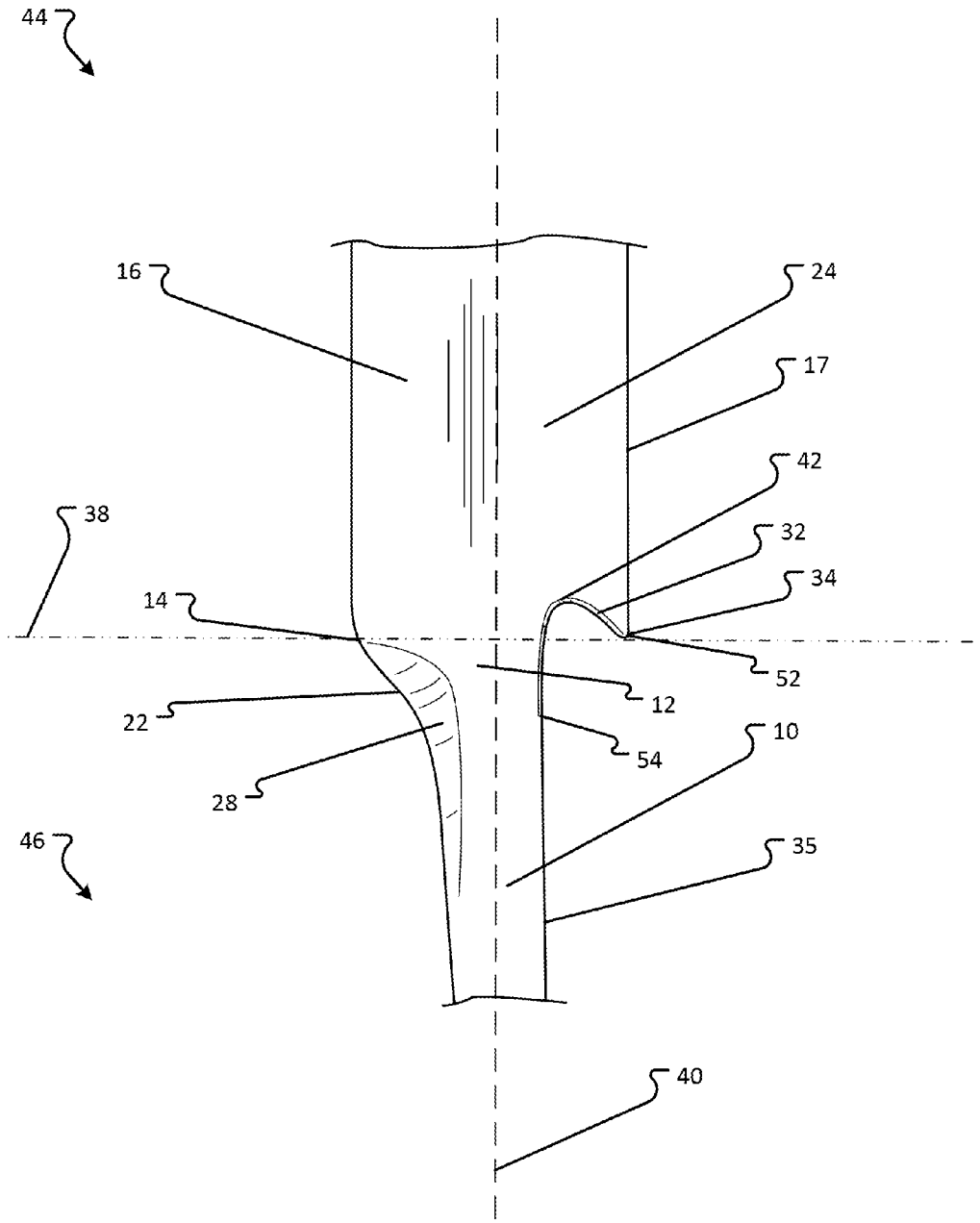
FIG. 8 is a three-dimensional view of the goalkeeper's stick shown in FIGS. 6A-7, showing the front face of the paddle near the grip portion.

FIG. 6A may show a front face 24 of the stick, and FIG. 6B may show a back face 26 of the stick. As shown in FIG. 7, the treatment of the faces 24, 26 of the stick, especially at the grip location 12, may be different. For example, the second portion 22 of the rear edge 15 may be beveled from the edge 16 towards the center portion 30. The bevel 28 may extend the length of the sloped second portion 22. The bevel 28 may be included on the front face 24 but not on the back face (not shown in FIG. 7) of the stick, as is shown in FIG. 7.

The bevel 28 and configuration of the first portion 32 of the rear edge 15 may allow a goaltender to grip the stick in a more ergonomically correct manner. Further, the goalie may extend one or more fingers 36 along the front face 24 of the paddle 16, to better control the rotation of the stick when struck by a puck on the blade 20. Thus, the improved grip is both more comfortable for players and allows for better control of the stick.

Figure 9:
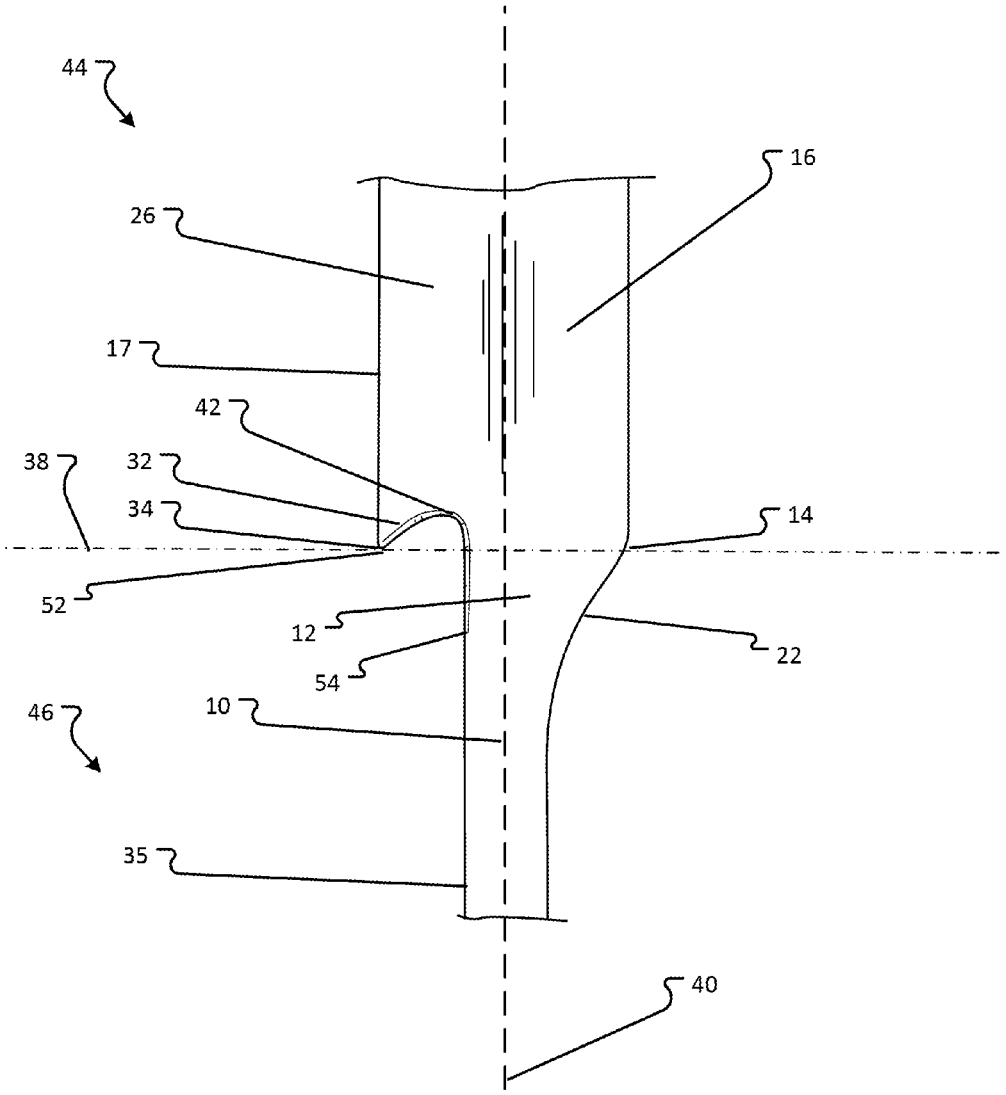
FIG. 9 is a three-dimensional view of the goalkeeper's stick shown in FIGS. 6A-8, similar to FIG. 8 but showing the back face of the paddle near the grip portion.
Figure 10:
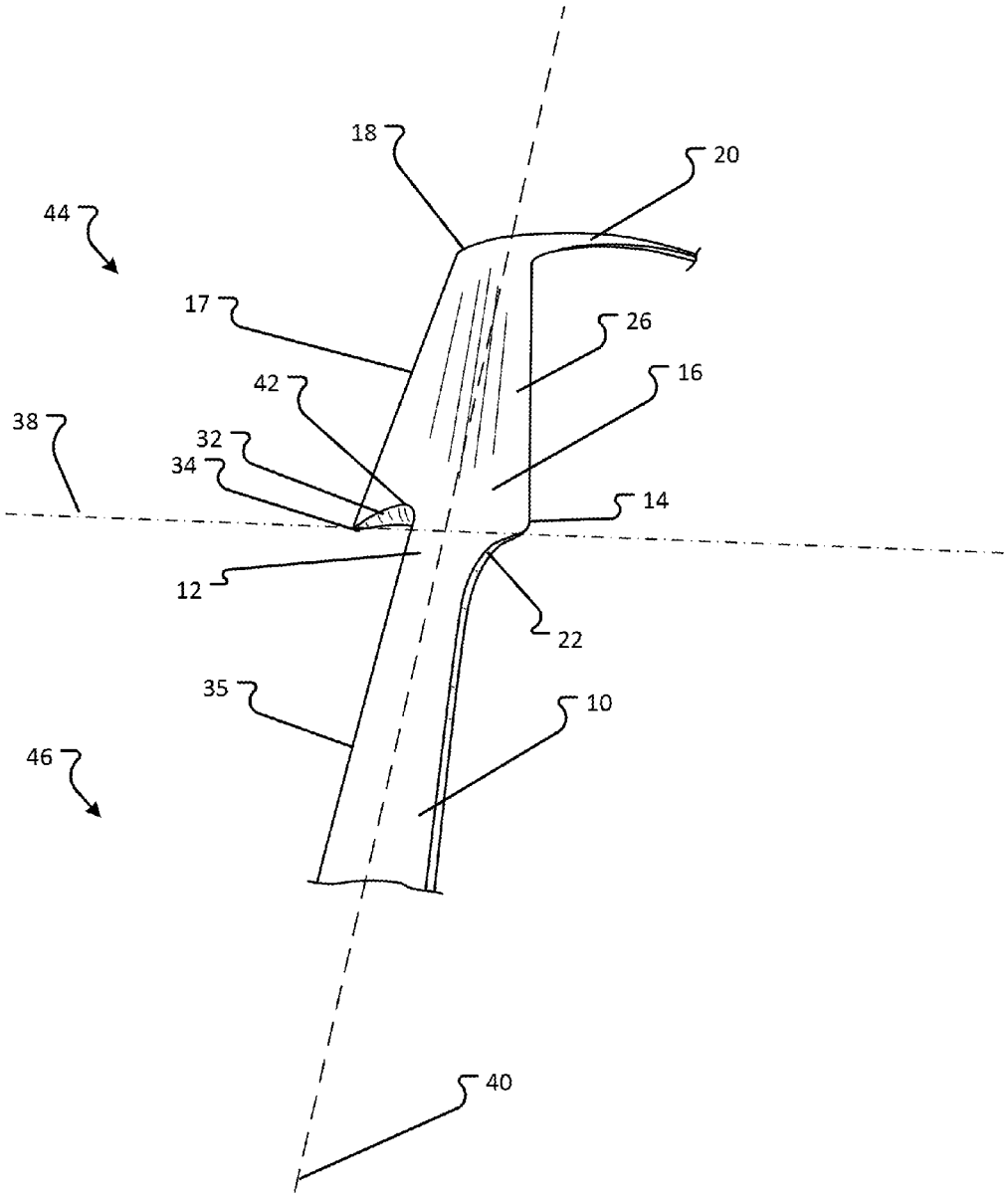
FIG. 10 is a three-dimensional view of the goalkeeper's stick shown in FIGS. 6A-9, showing an angled view of the back face of the paddle.
Figure 11:
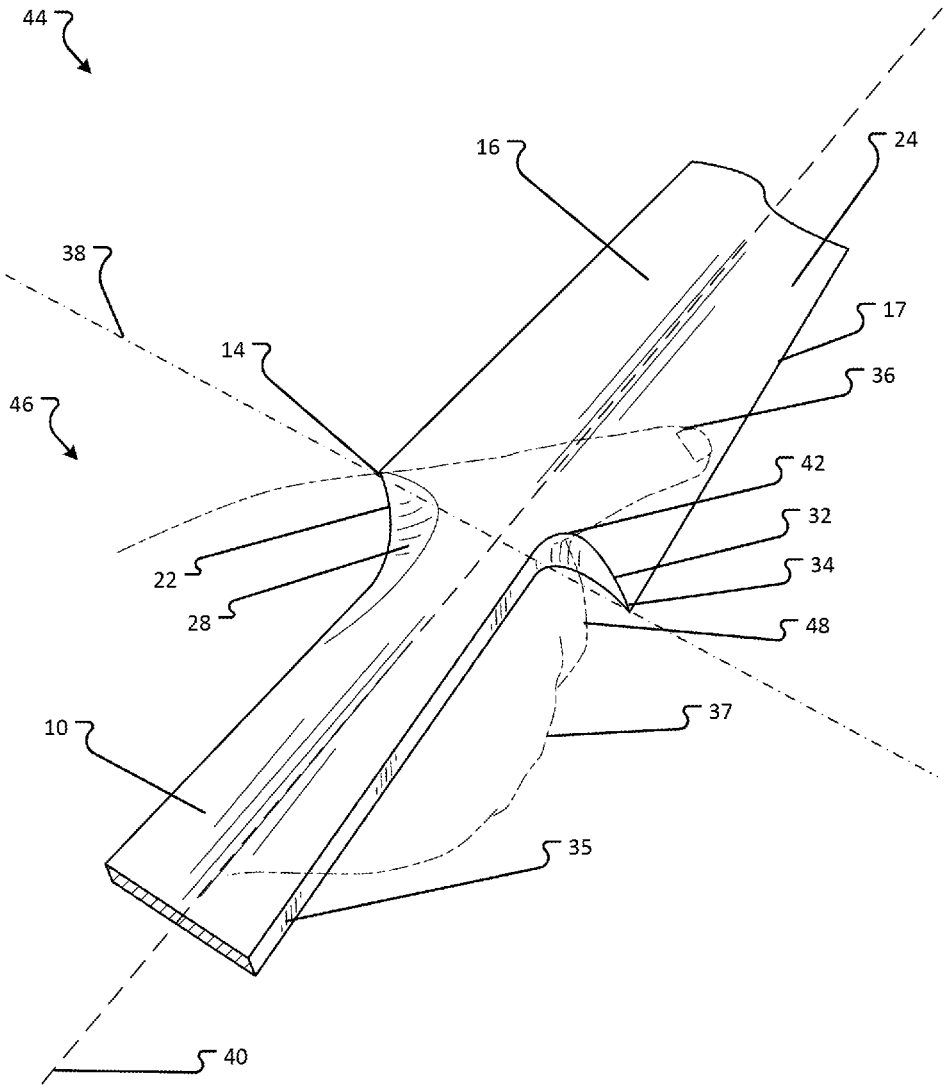
FIG. 11 is a three-dimensional view of the goalkeeper's stick shown in FIGS. 6A-10, showing an angled view of the front face of the paddle as well as the hand of a goalkeeper gripping the stick.
Figure 12:
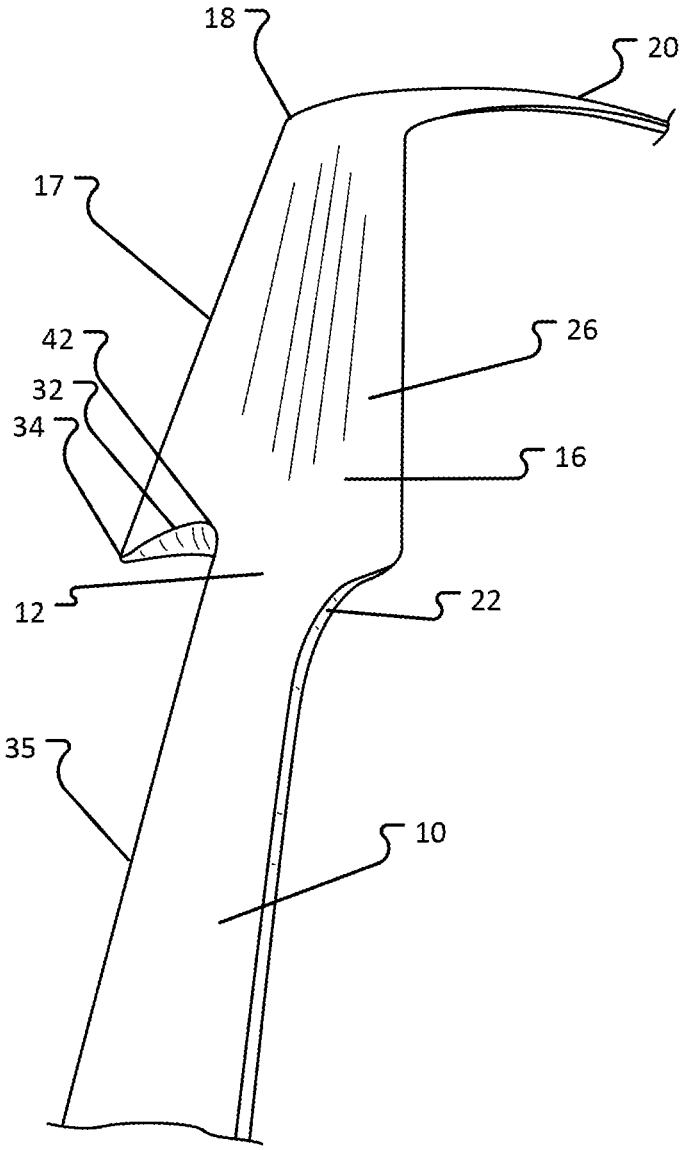
FIG. 12 is a three-dimensional view of the goalkeeper's stick shown in FIGS. 6A-11, showing an angled view of the back face of the paddle.
Figure 13:
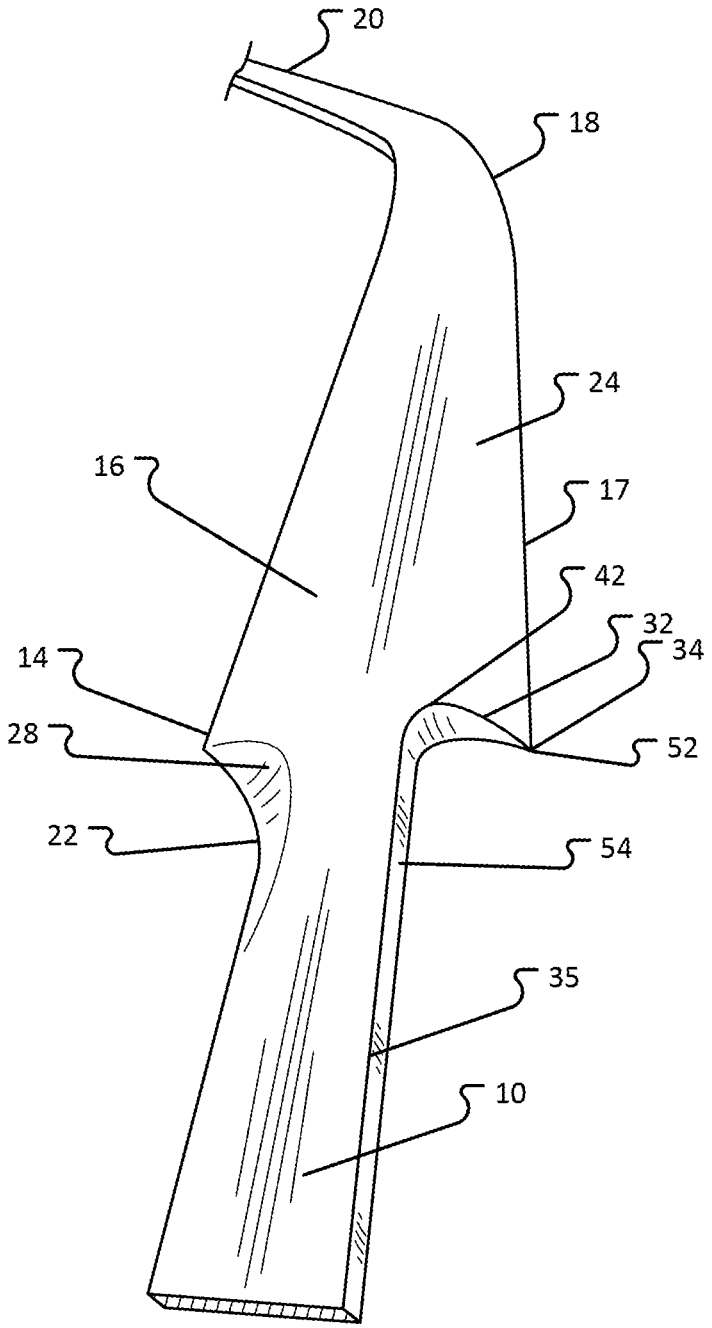
FIG. 13 is a three-dimensional view of the goalkeeper's stick shown in FIGS. 6A-12, showing an angled view of the front face of the paddle.

FIGS. 7-13 show a detailed view of the grip portion 12 of one embodiment of the stick. FIGS. 7, 8, 11 and 13 show the front face 24 of the paddle. FIGS. 9, 10 and 12 show the back face 26 of the paddle. In FIGS. 8-11, a longitudinal axis 40 lies parallel with the shaft 10 and the length of the paddle 16. Perpendicular to the longitudinal axis 40, for the purpose of illustrating the embodiment, is a plane 38. The plane 38 separates the stick into a paddle-side 44 and a shaft-side 46, wherein the shaft 10 lies on the shaft-side 46, while the blade 20 and the paddle 16 lie on the paddle-side 44.

As illustrated in FIGS. 7-13, the first portion 32 of the paddle 16 forms a spline 50 having a first point 54 on the lower edge 35 of the shaft 10 and a second point 52 on the bottom edge of the paddle 16. Between the first point and the second point of the spline 50 lies an apex 42. The first portion 32 creates an acute angle 34 where it meets the edge of the paddle 16. The apex 42 lies on the paddle-side 44 of the stick.

The goalkeeper's hand 37 may grip the stick as illustrated in FIG. 11. The goalkeeper may extend a finger 36 across the front face 24 of the paddle 16 to better control the stick. The goalkeeper's thumb may reach around to the back face (not shown in FIG. 11) of the paddle 16, using the bevel 28 on front face 24 of the paddle 16 on the second portion 22 for support. The goalkeeper's middle finger 48 may rest against the apex 42 of the spline 50 of the first portion 32.

The second portion 22 of the rear edge 15 may slope from the top rear edge 33 of the paddle 16 down towards the shaft 10. This second portion 22 may be beveled 28 on the front face 24 of the stick. This bevel 28 may not continue on the back face 26 of the paddle 16 as illustrated in FIG. 9. As can be seen in these figures, the bevel 28 does not continue onto the back face 26 of the paddle 16 at the second portion 22.

These modifications do not in any way alter the way in which the hockey stick is used by the player as described above with reference to the other embodiments.

The invention claimed is:

1. A hockey stick for use by a goalkeeper in playing hockey on a playing surface, the stick being comprised of:

a shaft having a first side, a second side, a lower edge, and a top edge, wherein a longitudinal axis lies parallel with the shaft;

a paddle having a first end and a second end, a front face and a back face, a top edge and a bottom edge, and a center portion between the top and bottom edges;

a blade combined with the paddle at the second end and angled from the paddle; and a grip portion formed at the first end of the paddle, wherein the grip portion of the shaft provides a space for the goalkeeper's hand to grip the shaft, and wherein a wrist of the goalkeeper is maintained at an angle substantially in line with an arm of the goalkeeper, wherein a plane lies across the grip portion and perpendicular with the longitudinal axis, wherein the plane has a paddle side and a shaft side, wherein the grip portion includes:

a first portion entirely formed on a first side of the stick, the first portion including a finger contact edge forming a spline having a first point on the lower edge of the shaft and a second point on the bottom edge of the paddle, wherein the spline runs from the lower edge of the shaft to the bottom edge of the paddle and forms an acute angle therebetween, and wherein an apex of the spline lies on the paddle side of the plane forming a concavity into the paddle; and a second portion entirely formed on a second side of the stick, the second portion including a thumb and/or palm contact edge forming a bevel running from the back face to the front face of the paddle and from the second side of the shaft to the top edge of the paddle and sloping away from the blade, wherein the first side and second sides of the shaft are on opposite sides of the shaft, and wherein the bevel is generally formed in the front face of the paddle at the second portion.

2. The hockey stick of claim 1, wherein the finger contact edge forms a concavity in the first portion.

3. The hockey stick of claim 1, wherein a slope is formed with the second portion.

4. The hockey stick of claim 1 in which the grip portion allows the goalkeeper to extend one or more fingers along a face of the paddle to control the angled hockey stick.

5. The hockey stick of claim 1, wherein the first end is combined with the shaft substantially at the center portion of the paddle.

6. A hockey stick for use by the goalkeeper in playing hockey on a playing surface, the stick being comprised of:

a shaft having a first side, a second side, a lower edge, and a top edge, wherein a longitudinal axis lies parallel with the shaft;

a paddle having a first end and a second end, a front face and a back face, a top edge and a bottom edge, and a center portion between the top and bottom edges, the first end being combined with the shaft substantially at the center portion of the paddle;

a blade combined with the paddle at the second end and angled from the paddle; and a grip portion formed at the first end of the paddle, wherein the grip portion of the shaft provides a space for the goalkeeper's hand to grip the shaft, and wherein a wrist of the goalkeeper is maintained at an angle substantially in line with an arm of the goalkeeper, wherein a plane lies across the grip portion and perpendicular with the longitudinal axis, wherein the plane has a paddle side and a shaft side, wherein the grip portion includes:

a first portion entirely formed on a first side of the stick, the first portion including a finger contact edge forming a spline having a first point on the lower edge of the shaft and a second point on the bottom edge of the paddle, wherein the spline runs from the lower edge of the shaft to the bottom edge of the paddle and forms an acute angle therebetween, and wherein an apex of the spline lies on the paddle side of the plane; and a second portion entirely formed on a second side of the stick, the second portion including a thumb and/or palm contact edge forming a bevel running from the back face to the front face of the paddle and from the second side of the shaft to the top edge of the paddle and sloping away from the blade, wherein the first side and second side of the shaft, are on opposite sides of the shaft, and wherein the bevel is generally formed in the front face of the paddle at the second portion wherein a concave is formed in the first portion toward a heel of the paddle.

7. The hockey stick of claim 6, wherein a bevel is formed in the front face of the second portion.

8. The hockey stick of claim 6, wherein a slope is formed with the second portion.

9. The hockey stick of claim 6 in which the grip portion allows the goalkeeper to extend one or more fingers along a face of the paddle to control the angled hockey stick.

10. A hockey stick for use by the goalkeeper in playing hockey on a playing surface, the stick being comprised of:

a shaft having a first side, a second side, a lower edge, and a top edge, wherein a longitudinal axis lies parallel with the shaft;

a paddle having a first end and a second end, a front face and a back face, a top edge and a bottom edge, and a center portion between the top and bottom edges, the first end being combined with the shaft substantially at the center portion of the paddle;

a blade combined with the paddle at the second end and angled from the paddle; and a grip portion formed at the first end of the paddle, wherein the grip portion of the shaft provides a space for the goalkeeper's hand to grip the shaft, and wherein a wrist of the goalkeeper is maintained at an angle substantially in line with an arm of the goalkeeper, wherein a plane lies across the grip portion and perpendicular with the longitudinal axis, wherein the plane has a paddle side and a shaft side, wherein the grip portion includes:

a first portion entirely formed on a first side of the stick, the first portion including a finger contact edge forming spline having a first point on the lower edge of the shaft and a second point on the bottom edge of the paddle, wherein the spline runs from the lower edge of the shaft to the bottom edge of the paddle and forms an acute angle therebetween, and wherein an apex of the spline lies on the paddle side of the plane; and a second portion entirely formed on a second side of the stick, the second portion including a thumb and/or palm contact edge forming a bevel running from the back face to the front face of the paddle and from the second side of the shaft to the top edge of the paddle and sloping away from the blade, wherein the first side and second side of the shaft are on opposite sides of the shaft, and wherein the bevel is generally formed in the front face of the paddle at the second portion wherein a concave is formed in the first portion toward a heel of the paddle, wherein a slope is formed with the second portion, and wherein the grip portion allows the goalkeeper to extend one or more fingers along a face of the paddle to control the angled hockey stick.

* * * * *